US007555788B2

(12) United States Patent
Schimpf

(10) Patent No.: US 7,555,788 B2
(45) Date of Patent: Jul. 7, 2009

(54) INTEGRAL HELMET

(75) Inventor: Oliver Schimpf, Braunschweig (DE)

(73) Assignee: Schuberth GmbH, Magdenburg (DE)

( * ) Notice: Subject to any disclaimer, the term of this patent is extended or adjusted under 35 U.S.C. 154(b) by 121 days.

(21) Appl. No.: 11/576,599

(22) PCT Filed: Sep. 9, 2005

(86) PCT No.: PCT/DE2005/001743

§ 371 (c)(1),
(2), (4) Date: Apr. 3, 2007

(87) PCT Pub. No.: WO2006/037293

PCT Pub. Date: Apr. 13, 2006

(65) Prior Publication Data

US 2007/0250993 A1 Nov. 1, 2007

(30) Foreign Application Priority Data

Oct. 4, 2004 (DE) ..... 10 2004 048 839

(51) Int. Cl.
*A42B 3/22* (2006.01)

(52) U.S. Cl. ..... 2/6.5; 2/410

(58) Field of Classification Search ..... 2/410, 2/6.3, 6.5, 424, 6.8, 6.7, 421
See application file for complete search history.

(56) References Cited

U.S. PATENT DOCUMENTS 4,354,285 A * 10/1982 Rudd ..... 2/424
4,462,119 A * 7/1984 Rudd ..... 2/424
4,546,498 A 10/1985 Fantin et al. ..... 2/424
4,794,652 A * 1/1989 Piech von Planta et al. ..... 2/414
5,084,918 A * 2/1992 Breining et al. ..... 2/424
5,093,939 A * 3/1992 Noyerie et al. ..... 2/424
5,301,372 A * 4/1994 Matoba ..... 2/424

(Continued)

FOREIGN PATENT DOCUMENTS

DE 2846636 10/1978

(Continued)

*Primary Examiner*—Gary L. Welch
*Assistant Examiner*—Richale L Quinn
(74) *Attorney, Agent, or Firm*—Whitham Curtis Christofferson & Cook, P.C.

(57) ABSTRACT

The invention relates to an integral helmet comprising a shock resistant helmet shell (1) which covers the top part of the head to the neck and the ear area of a user, defines a visor opening (3) at lower and top edges and is complimented by the chin area defining the lower side of the visor opening in such a way that a slip opening (19) which totally encompasses the neck of the helmet user is formed, wherein the chin area is connected to the helmet shell (1) which upwardly pivots around a horizontal axis of rotation for enlarging the slip opening (19). The aim of said invention is to develop a light identically safe helmet. For this purpose, the chin area comprises a chin element (8) which is connected to a lateral area (4) of the shell (1) in such a way that it is pivotable around a rotatable joint having a substantially horizontal axis in order to increase the slip opening (19). When said chin element is closed, it extends away from the lateral area (4) of the shell over half the width of the visor opening and is connectable to the helmet element (5) adjacent to an edge (18) by the free end thereof.

6 Claims, 6 Drawing Sheets

U.S. PATENT DOCUMENTS

| | | | | |
|---|---|---|---|---|
| 5,412,810 | A * | 5/1995 | Taniuchi | 2/424 |
| 5,517,698 | A * | 5/1996 | Nault et al. | 2/424 |
| 6,226,803 | B1 * | 5/2001 | Tanaka | 2/424 |
| 6,249,918 | B1 * | 6/2001 | Lacroix | 2/424 |
| 2007/0064799 | A1 * | 3/2007 | Ha | 375/240.12 |

FOREIGN PATENT DOCUMENTS

| | | |
|---|---|---|
| DE | 2853260 | 12/1978 |
| EP | 0797935 | 10/1997 |
| EP | 0972461 | 1/2000 |
| EP | 1106090 | 6/2001 |
| EP | 1183957 | 3/2002 |
| EP | 1312274 | 5/2003 |
| EP | 1 393 642 A1 | 3/2004 |

* cited by examiner

INTEGRAL HELMET

FIELD OF THE INVENTION

An integral helmet with an impact-resistant helmet shell (1) which covers the upper part of the head down to the back of the neck and the ear region of a helmet wearer and defines a visor opening (3) at an upper edge and at lateral edges and is supplemented by a chin region, defining the lower side of the visor opening (3), so as to form the integral helmet and to constitute an access opening (19) which completely surrounds the neck of the helmet wearer, the chin region being connected to the helmet shell (1) such that it can be pivoted up about a horizontal pivot axis so as to enlarge the access opening (19).

BACKGROUND

Integral helmets of this type have primarily been known in the form of so-called "flip-up helmets". They comprise a chin part which extends over the entire chin region and is connected to the helmet shell on both sides thereof via pivot joints which each have a substantially horizontal pivot axis, with the result that the chin part performs a pivoting movement which corresponds to the pivoting movement of a visor panel that usually covers the visor opening. Such an integral helmet is disclosed, for example, in DE 28 46 636 A1.

DE 28 53 260 also discloses designing a central piece of the chin part such that it can swing at one side about a vertical axis, with the result that a chin part can be swung open in the central region of the chin region. The chin part is provided with two lateral extension pieces which can be connected in an overlapping manner to extension pieces of the helmet shell that project into the chin region. Locking is performed by vertically movable pins of the chin part that can engage vertically into corresponding blind holes in the extension pieces of the helmet shell. However, such a design of the chin region does not allow the required stability.

No objections can be raised from the safety point of view with regard to the customary flip-up helmets of the aforementioned type whose chin parts are mounted such that they can be pivoted up and over the visor opening. However, they do have a relatively high weight as a result of the fastening and locking means required for movably fastening the chin part to the helmet shell.

SUMMARY

The object on which the invention is based is to design an integral helmet of the aforementioned type such that it can be made lighter while maintaining the same level of safety.

To achieve this object, according to the invention an integral helmet of the aforementioned type is characterized in that the chin region comprises a chin part connected to a lateral region of the helmet shell, and this chin part can be pivoted about a pivot joint having a substantially horizontal pivot axis so as to enlarge the access opening and, when in the closed state, extends from the lateral region of the helmet shell over more than half the width of the visor opening and can have its free end connected via a lock mechanism to a part of the helmet that adjoins via a butting edge.

Provision is thus made in the integral helmet according to the invention for a movable chin part which extends from one side of the helmet shell to the other side of the helmet, in which the chin part projects over significantly more than half the width of the visor opening. In this respect, the chin part may extend over the entire chin region and bear against the helmet shell, preferably via a stop edge. However, in a preferred embodiment, the free end of the chin part bears against an extension piece of the helmet shell that extends into the chin region, the extension piece projecting by only a small amount into the chin region, i.e. extending, for example, over less than a quarter of the width of the visor opening. In a preferred embodiment, this extension piece may be connected in one piece with the helmet shell. However, it is also possible for the extension piece itself to be designed such that it can be moved relative to the helmet shell, so that, using the chin part, the access opening can be enlarged for normal helmet placement and removal by the helmet wearer himself, while, the helmet wearer himself can enlarge the access opening using the chin part for the normal action of putting on and taking off the helmet, but, following an accident, the access opening can be enlarged even further by moving the extension piece, in particular by swinging up this piece.

In all cases, the enlargement of the access opening intended for normal use is brought about by an asymmetric chin part which is connected by a strong connection, in the form of a stable pivot joint having a substantially horizontal pivot axis, to the lateral region of the helmet shell and which thus extends completely over one half of the chin region and has its free end also extending significantly into the other half of the chin region, with the result that, in a preferred embodiment, the chin part takes up at least approximately ⅔ of the chin region.

DESCRIPTION OF THE DRAWINGS

The invention will be explained in more detail below with reference to an exemplary embodiment represented in the drawing, in which.

DETAILED DESCRIPTION

Figure 1:
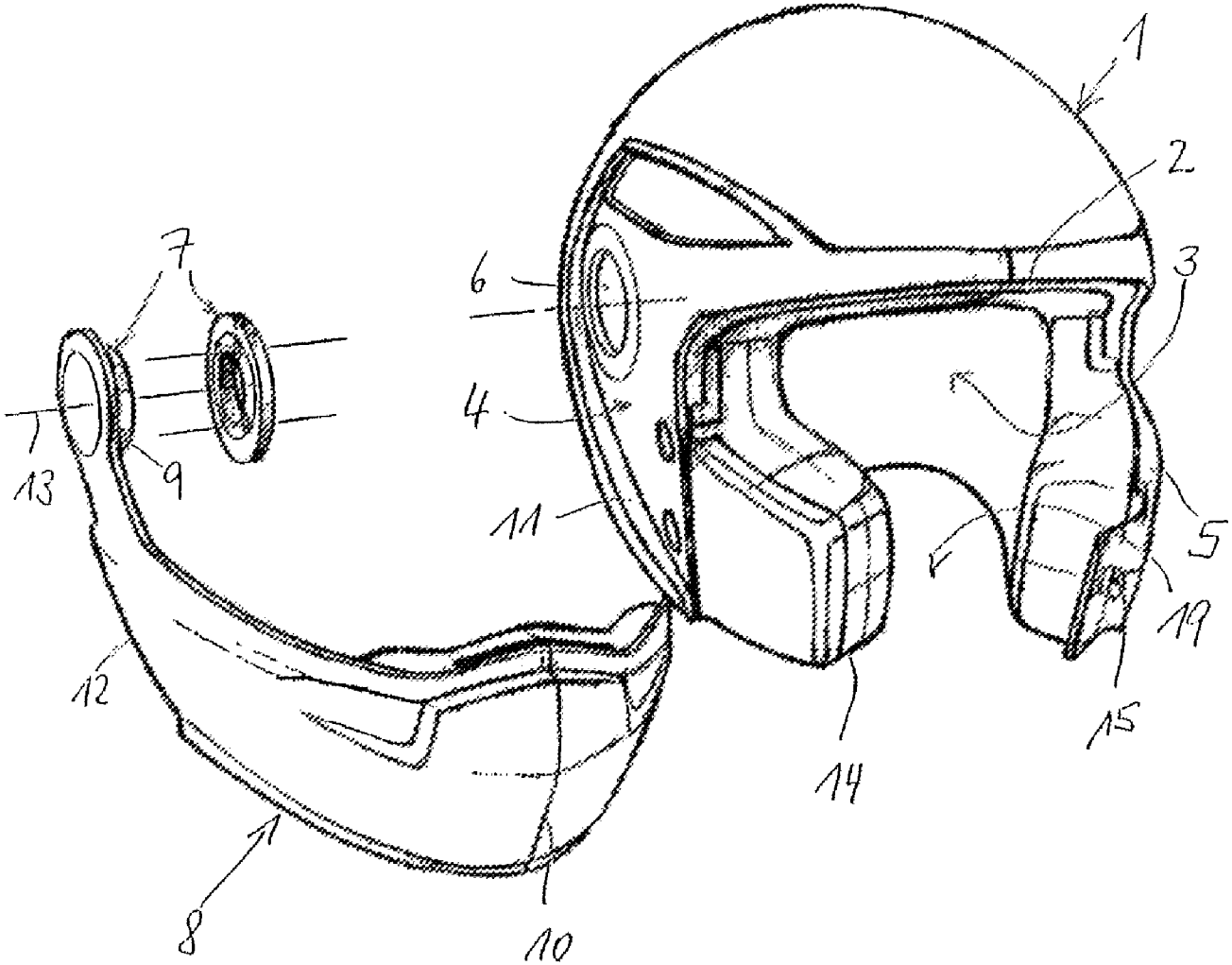
FIG. 1 shows a perspective representation of an integral helmet according to the invention comprising a helmet shell and a chin part, in an exploded representation.

The integral helmet represented in the drawing comprises a helmet shell 1 which extends from a front edge 2 over the top part of the head into the rear neck region and over the ear regions of a helmet wearer. The helmet shell forms an upper and lateral defining edge for a visor opening 3.

In the exemplary embodiment represented, the helmet shell 1 forms the lateral regions 4 which cover the ear regions of the helmet wearer and from which an extension piece 5 extends on one side into a chin region.

On the opposite lateral part 4 is formed a through opening 6 for a stable pivot joint 7 by means of which a chin part 8 can be swivelably fastened to the helmet shell 1. The chin part 8 terminates in a pivot joint part 9 of the pivot joint 7 and extends on the relevant side of the helmet shell 1 over the entire chin region and beyond a central edge 10 into the chin region on the other side up to the extension piece 5.

It can be seen from FIG. 1 that the helmet shell 1 is provided in its lateral region 4 with a projection which forms a butting edge 11 and which, in combination with a rear edge 12 of the chin part 8, limits the downward movement of the chin part 8 about a horizontal pivot axis 13 of the pivot joint 7.

It can also be seen from FIG. 1 that the helmet shell 1 is provided with an inner lining 14 which is formed in the usual manner by a shock-damping inner shell and padding parts.

The chin part 8 is thus formed asymmetrically and extends from the pivot joint 7 to the extension piece 5, to which it can be connected via a lock arrangement 15, which is only schematically indicated in FIG. 1.

The central edge 10 is situated halfway across the width of the visor opening 3 and merely constitutes a design feature.

Figure 2:
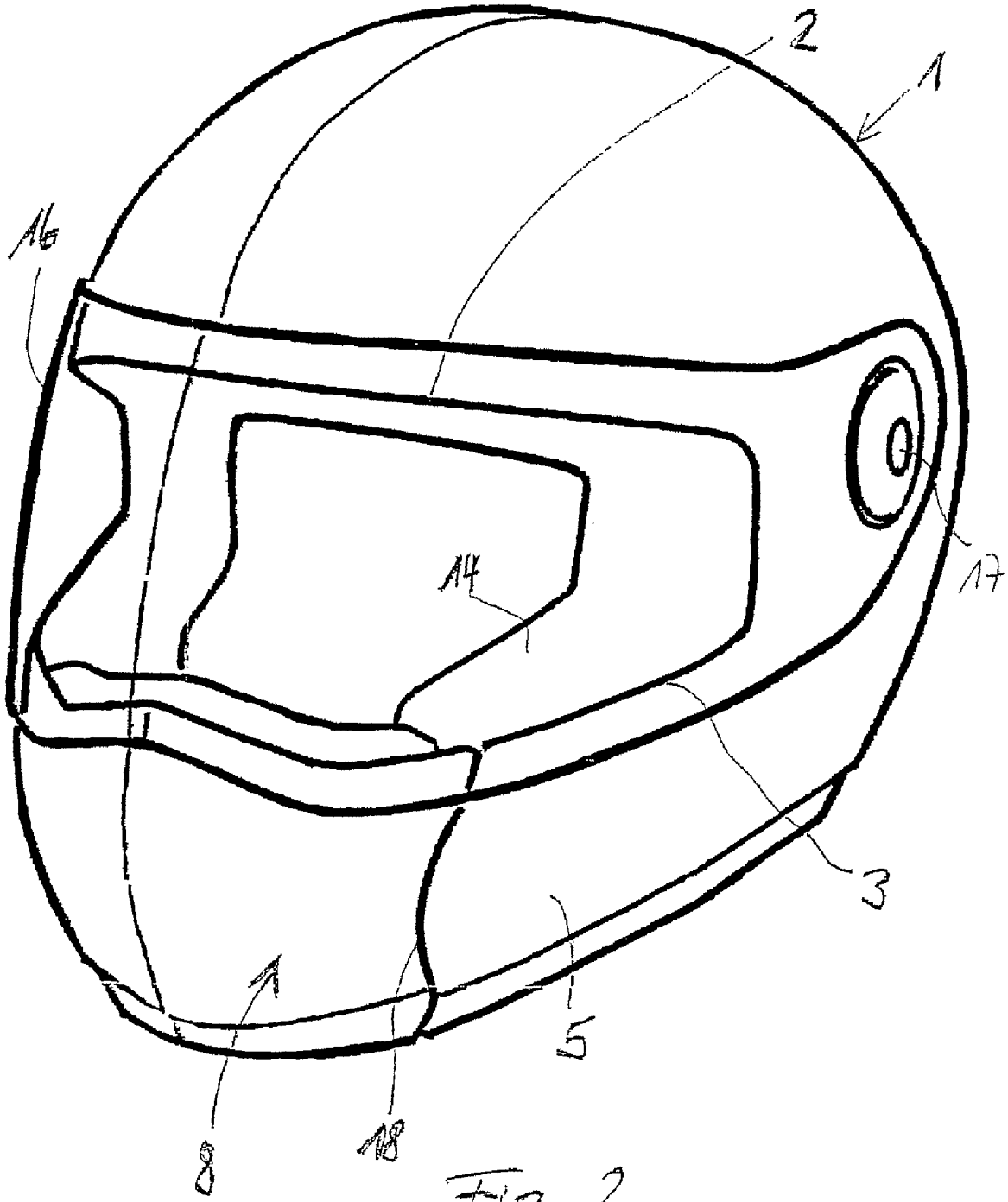
FIG. 2 shows a perspective view of an integral helmet according to the invention in the assembled and closed state.
Figure 3:
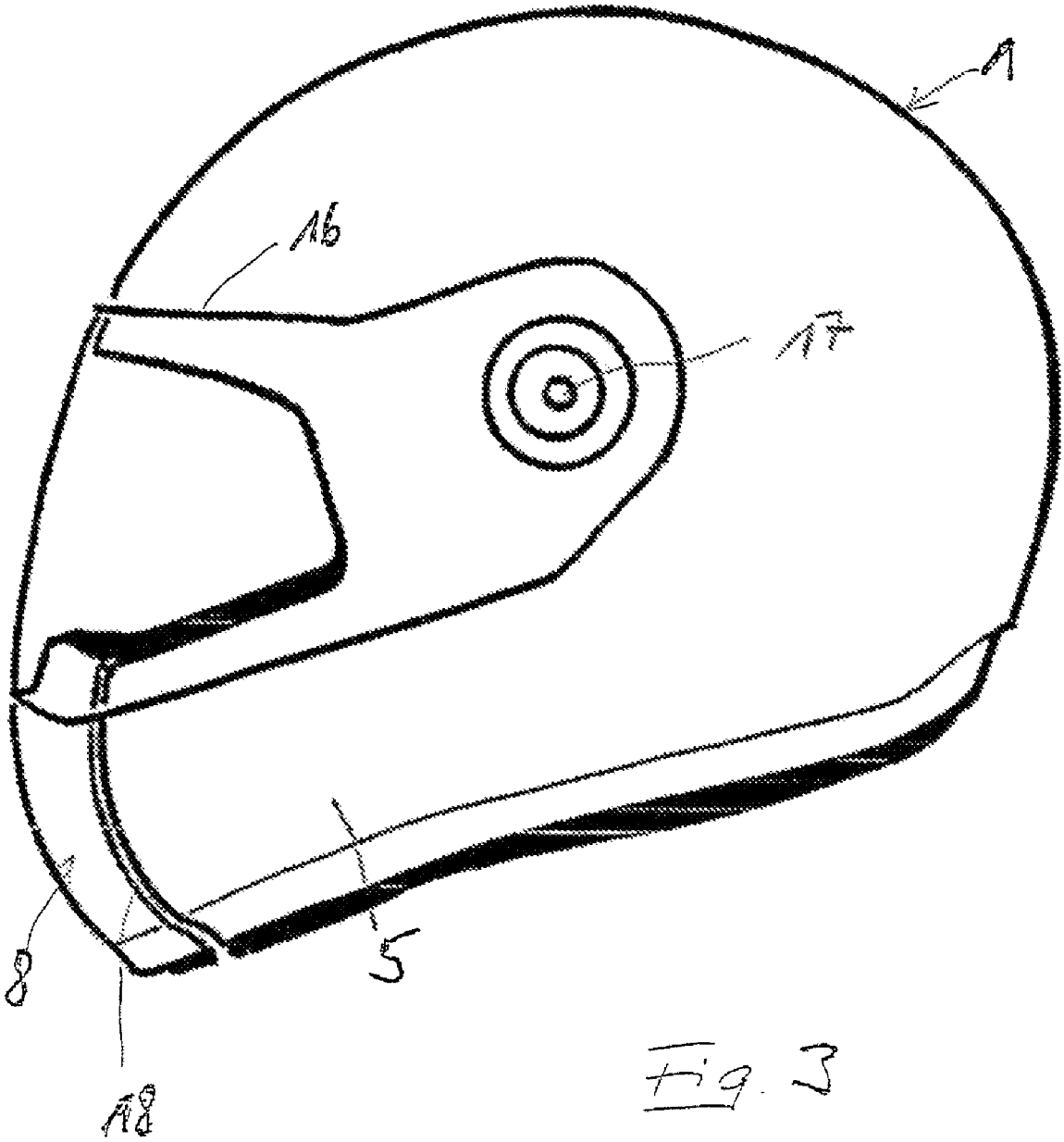
FIG. 3 shows a side view of the helmet according to FIG. 2.

FIGS. 2 and 3 illustrate that the extension piece 5 in the exemplary embodiment represented is connected in one piece with the helmet shell 1. The chin part extends over more than ⅔ of the width of the visor opening 3. When the helmet is in the assembled state, as is represented in FIGS. 2 and 3, the visor opening 3 is covered in the customary manner by a visor panel 16 pivotally mounted on the helmet shell 1. The visor panel 16 is mounted such that it can be pivoted up by means of pivot joints 17 on the helmet shell 1.

FIGS. 2 and 3 show that the free end of the chin part 8 bears via a butting edge 18 against the extension piece 5.

In the closed state represented in FIGS. 2 and 3, the helmet shell 1 and the chin part 8 form an access opening 19 which is closed on all sides, as can be seen from FIG. 1 (in the as yet non-closed state).

Figure 4:
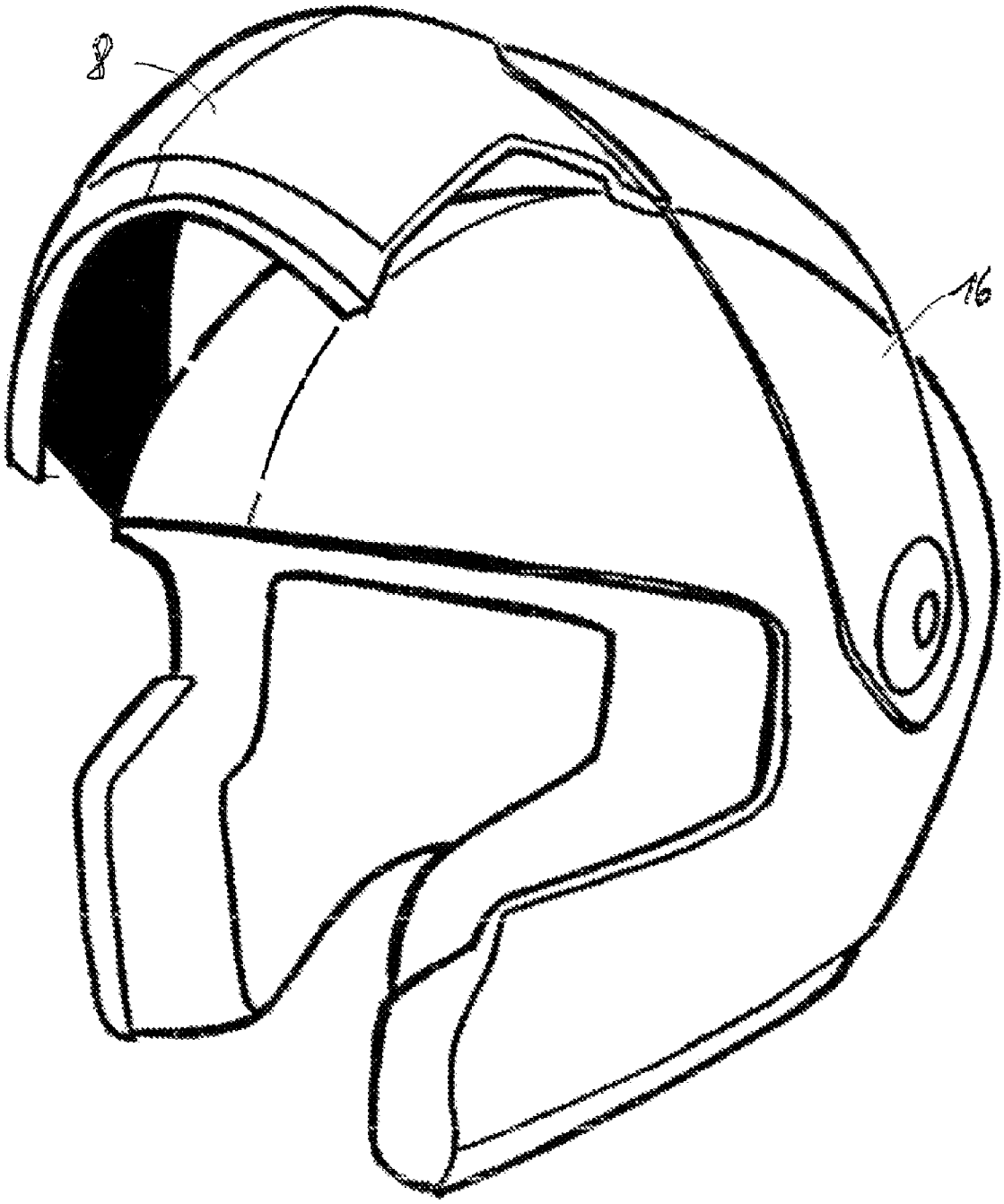
FIG. 4 shows a perspective representation of the helmet according to FIG. 2, with the chin part swung up.

FIG. 4 shows that the chin part 8 can be swung up and takes along the visor panel 16 during the swinging-up movement. In this position the helmet can be removed comfortably from the head of the helmet wearer or placed onto the head of the helmet wearer.

Figure 5:
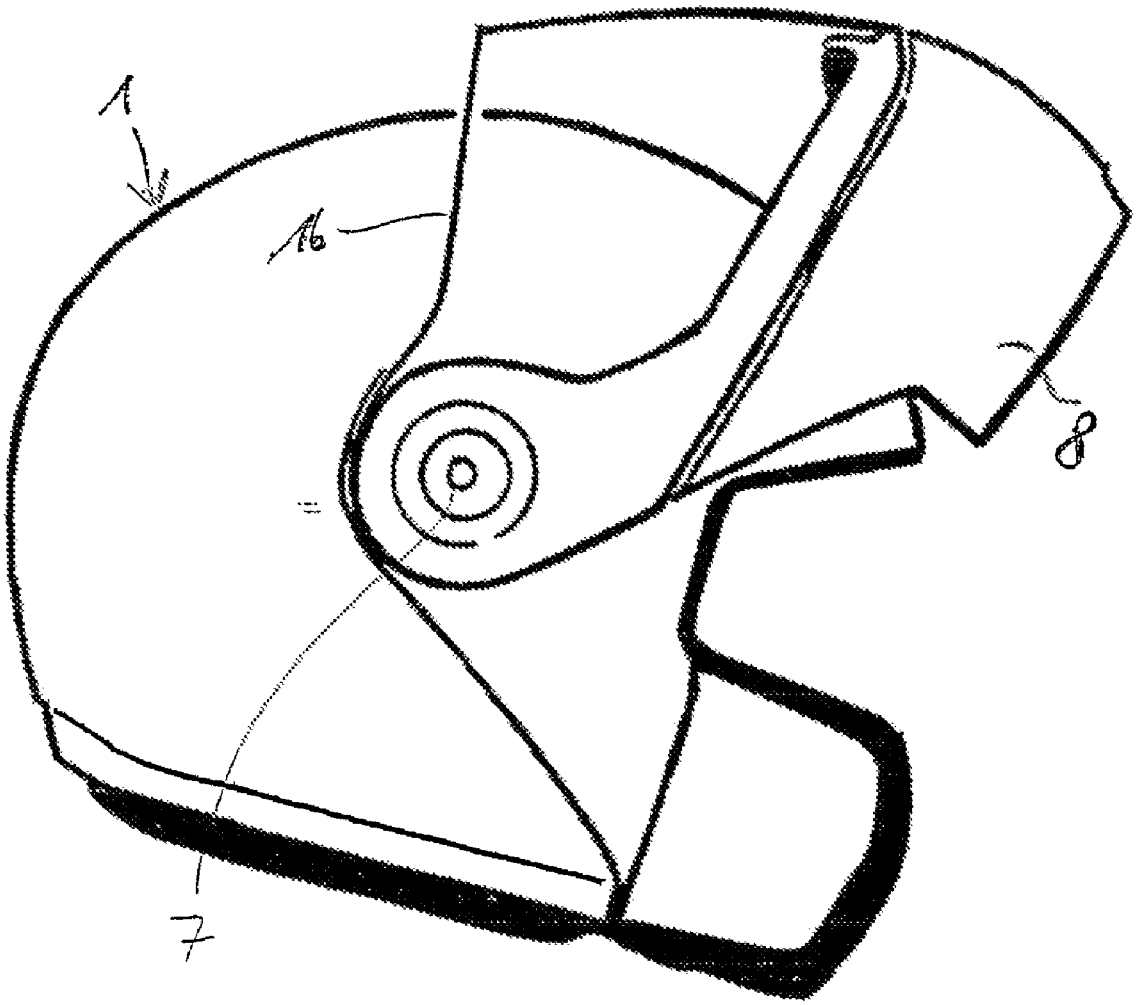
FIG. 5 shows a side view of the side of the helmet according to FIG. 4 that is provided with the pivot joint for the chin part.

FIG. 5 illustrates that the chin part 8 can be swung up about the pivot joint 7, to which the visor panel 16 is also fastened such that it can be swung up. In this case, the pivot axis 13 for the chin part 8 and for the visor panel 16 are coincident.

Figure 6:
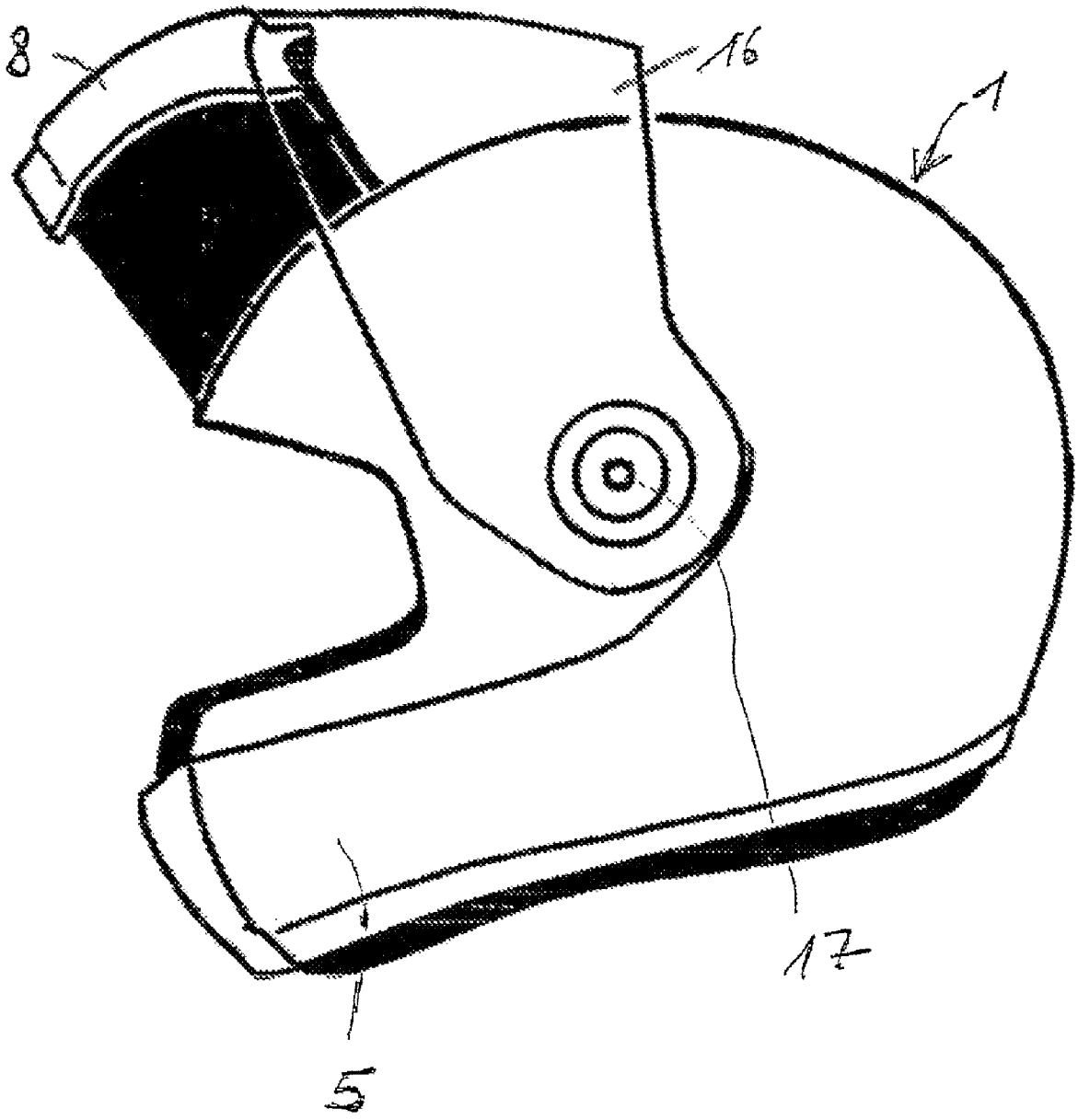
FIG. 6 shows a view of the other side of the helmet according to FIG. 4.

FIG. 6, by contrast, illustrates that the pivot joint 17 on the other side of the helmet shell 1 is intended only for the pivoting of the visor panel 16, since the chin part 8 does not extend as far as the pivot joint 17.

Since, given the one-piece design of the extension piece 5 with the shell 1, it cannot be seen from FIG. 6 where the chin region begins in the context of this description, it should be pointed out that the lateral end of the visor opening 3 is usually regarded as the transition line to the chin region. In the representation of FIG. 1, the approximately vertically extending front edge of the lateral region 4 of the helmet shell 1 thus constitutes the transition line to the chin region. The same applies to an imaginary mirror-symmetrical line on the other side of the helmet (view according to FIG. 6).

The asymmetric design of the chin part represented allows sufficient enlargement of the access opening 19 in order to put on and take off the integral helmet and thus makes it possible, by virtue of its configuration, for the chin part 8 to be articulated using only one pivot joint 7 in the lateral region 4 of the crash helmet and makes it possible to use only one lock arrangement 15 on the butting edge between the free end of the chin part 8 and the helmet shell 1, wherein the butting edge can be produced on the extension piece 5, for example. In a variant of the embodiment represented, it is possible to prolong the chin part 8 to such an extent that the butting edge 18 is formed as a front edge of the lateral region 4 on this side of the helmet shell 1, with the result that an extension piece 5 supplementing the chin part 8 can be dispensed with. In this case, too, only one pivot joint 7 and one lock arrangement 15 are required.

Investigations have revealed that—unlike the completely symmetrical design of a movable chin part in the prior art—the asymmetric design of the chin part 8 according to the invention is capable of achieving identical safety values in spite of the elimination of one pivot joint and of one lock arrangement.

The invention claimed is:

1. An integral helmet, comprising:

an impact-resistant helmet shell which covers the upper part of the head down to the back of the neck and the ear region of a helmet wearer;

a visor opening defined at an upper edge and at lateral edges by the helmet shell;

a chin portion defining a lower side of the visor opening over a width of said visor opening and supplementing the helmet shell so as to form the integral helmet and to form an access opening which completely surrounds the neck of the helmet wearer, said chin portion having a pivot end and a locking end;

a single chin portion pivot joint positioned on a first side of said helmet having a substantially horizontal pivot axis, said pivot end of said chin portion being connected to said helmet at said single chin portion pivot joint with said chin portion being pivotable about said pivot axis so as to enlarge the access opening; and a locking mechanism for connecting said locking end of said chin portion to a part on a second side of said helmet, wherein when said chin portion is in a closed state, the chin portion extends from a lateral region on said first side of the helmet shell over more than half the width of the visor opening to said part on said second side of said helmet.

2. The integral helmet as claimed in claim 1, wherein said locking end of said chin portion bears against the helmet shell at said part on said second side of said helmet.

3. The integral helmet as claimed in claim 2 wherein said part on said second side of said helmet extends into a chin region at one of said lateral edges.

4. The integral helmet as claimed in claim 1 wherein said part on said second side or said helmet shell is connected in one piece with said helmet shell.

5. The integral helmet as claimed in claim 1, characterized in that the chin portion extends over more than approximately ⅔ of the width of the visor opening.

6. The integral helmet as claimed in claim 1 wherein said helmet shell includes a butting edge and said first side of said element and wherein said chin portion includes a rear edge, and wherein said butting edge and said rear edge abut against each other when said chin portion is in said closed state and said butting edge and rear edge prevent pivoting of said chin portion about said pivot axis beyond said closed state.

* * * * *

UNITED STATES PATENT AND TRADEMARK OFFICE

CERTIFICATE OF CORRECTION

PATENT NO. : 7,555,788 B2
APPLICATION NO. : 11/576599
DATED : July 7, 2009
INVENTOR(S) : Oliver Shimpt It is certified that error appears in the above-identified patent and that said Letters Patent is hereby corrected as shown below:

On the Title Page Item (22) the PCT Filed date should read as: Sep. 29, 2005

Signed and Sealed this

Thirteenth Day of October, 2009

David J. Kappos

David J. Kappos
*Director of the United States Patent and Trademark Office*